US005562518A

United States Patent [19]

Estrada

[11] Patent Number: 5,562,518

[45] Date of Patent: Oct. 8, 1996

[54] TELESCOPIC PINATA

[76] Inventor: Luis I. Estrada, 4462 SW. 10th St., Miami, Fla. 33134

[21] Appl. No.: 508,719

[22] Filed: Jul. 28, 1995

[51] Int. Cl.[6] ..... A63H 33/00

[52] U.S. Cl. ..... 446/5; 446/71; 446/487; 220/8

[58] Field of Search ..... 220/8, 666; 206/457; 446/4, 5, 69, 117, 71, 76, 77, 79, 487, 489, 490; 434/365, 259

[56] References Cited

U.S. PATENT DOCUMENTS

| | | | |
|---|---|---|---|
| 1,040,652 | 10/1912 | Douglas | 220/8 |
| 3,300,040 | 1/1967 | Ferguson | 206/457 |
| 4,253,266 | 3/1981 | Bajo . | |
| 4,699,601 | 10/1987 | Hershfeld | 446/117 X |
| 4,832,337 | 5/1989 | Estrada | 446/5 |
| 4,973,189 | 11/1990 | Bechtold | 220/8 X |
| 5,074,417 | 12/1991 | Kenny | 206/457 X |
| 5,101,996 | 4/1992 | Mosley | 220/8 |
| 5,242,308 | 9/1993 | Estrada . | |
| 5,255,834 | 10/1993 | Bendersky | 206/457 X |
| 5,379,911 | 1/1995 | Goto et al. | 206/457 X |
| 5,417,337 | 5/1995 | Robbins, III | 220/8 |

FOREIGN PATENT DOCUMENTS

| | | | |
|---|---|---|---|
| 0281793 | 8/1990 | German Dem. Rep. | 220/8 |
| 465864 | 5/1937 | United Kingdom | 220/8 |

*Primary Examiner*—Robert A. Hafer
*Assistant Examiner*—D. Neal Muir
*Attorney, Agent, or Firm*—J. Sanchelima

[57] ABSTRACT

The present invention relates to a reusable telescopic pinata that includes a collapsible container assembly with two or more coaxially disposed tubular members. These tubular members are releasably kept together by several locking tabs. A base assembly is hingedly mounted to the lowermost tubular member. A latching mechanism holds the base assembly against the bottom rim of the lowermost tubular member. With a plurality of strings attached to the hingedly mounted base assembly, the participants release the candy and toys stored inside the container assembly. The tubular members can be substituted thereby resulting in different design combinations, and also the number of tubular members can be varied. The tubular members in one of the embodiments are composed of two substantially symmetrical sections that are removably latched to each other for storage volumetric efficiency.

2 Claims, 3 Drawing Sheets

TELESCOPIC PINATA

BACKGROUND OF THE INVENTION

1. Field of the Invention.

The present invention relates to a telescopic pinata, and more particularly, to the type that is reusable.

2. Description of the Related Art.

Many designs for pinatas exist today. None of them, however, disclose the features claimed in the present application.

The closest related reference corresponds to a "Collapsible and Reusable Pinata" disclosed in U.S. Pat. No. 4,253,266 issued to R. Bajo in 1981. However, Bajo's patented invention requires the use of portion (strings) 46 and (straps) members 54 within the interior volume 32 of the pinata. These elements cause interference with the candy, toys and other objects typically placed inside pinatas. Also, and in contrast with the present invention, the bottom of Bajo's pinata requires repair after use.

Another reference corresponds to U.S. Pat. No. 5,242,308 for "Reusable Pinata Games having Releasably Latched Closure" issued to this applicant, Luis I. Estrada in 1993. This patent does not have a collapsible container assembly that is disclosed in the present invention nor the locking mechanism for keeping it in distended position.

SUMMARY OF THE INVENTION

It is one of the main object of the present invention to provide a pinata that is collapsible and telescopic, thereby being comfortable for transporting and volumetrically efficient for storage.

It is another object of the present invention to provide a pinata that can be displayed in its distended telescopic position without requiring additional devices to keep it in that position.

It is another object of the present invention to provide a pinata that has a such structure that permits it to be used several times without requiring any repairs.

It is another object of the present invention to provide a pinata that includes tubular members that are readily interchangeable to permit different combinations of designs.

It is still another object of the present invention to provide a device that can be filled with candies, toys and different games for children, without being interfered with by internal components of the pinata.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
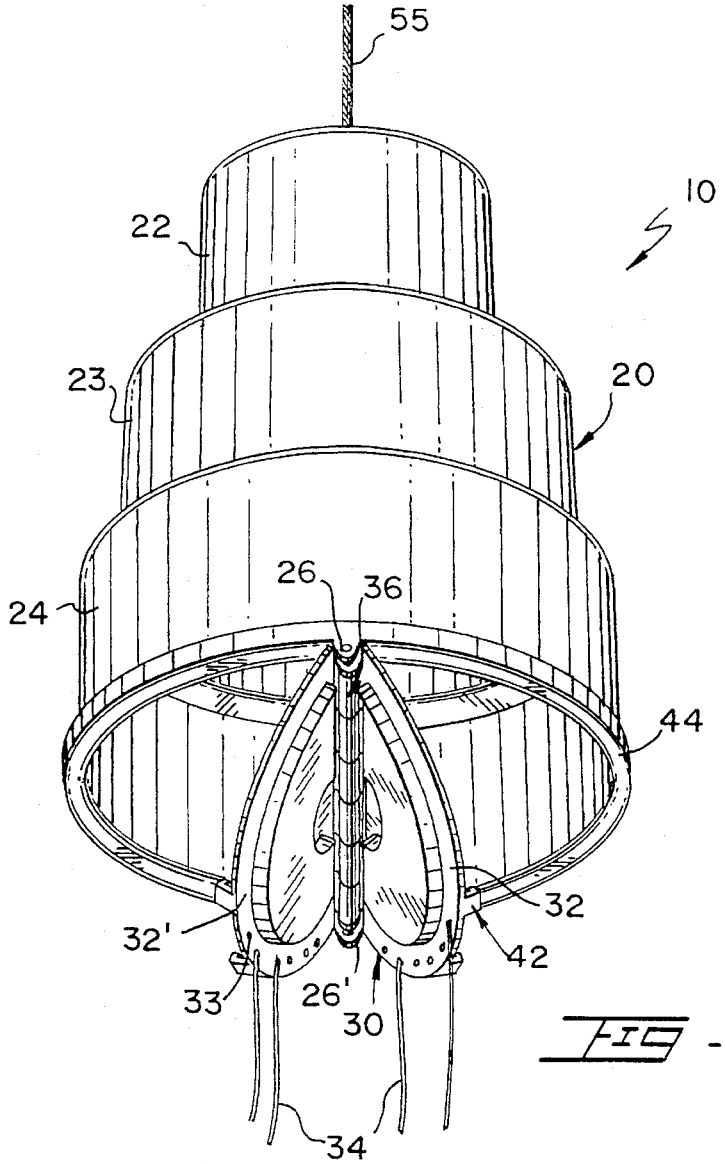
FIG. 1 represents an isometric view from the bottom of the present invention showing the base assembly open.

Referring now to the drawings, where the present invention is generally referred to with numeral 10, it can be observed that it basically includes collapsible container assembly 20 that has, in the preferred embodiment, three coaxially disposed tubular members 22; 23 and 24, base assembly 30 pivotally mounted to lowermost and largest diameter tubular member 24 and latching mechanism 40 for holding assembly 30 against the bottom flanged rim 44 of member 24.

Figure 4:
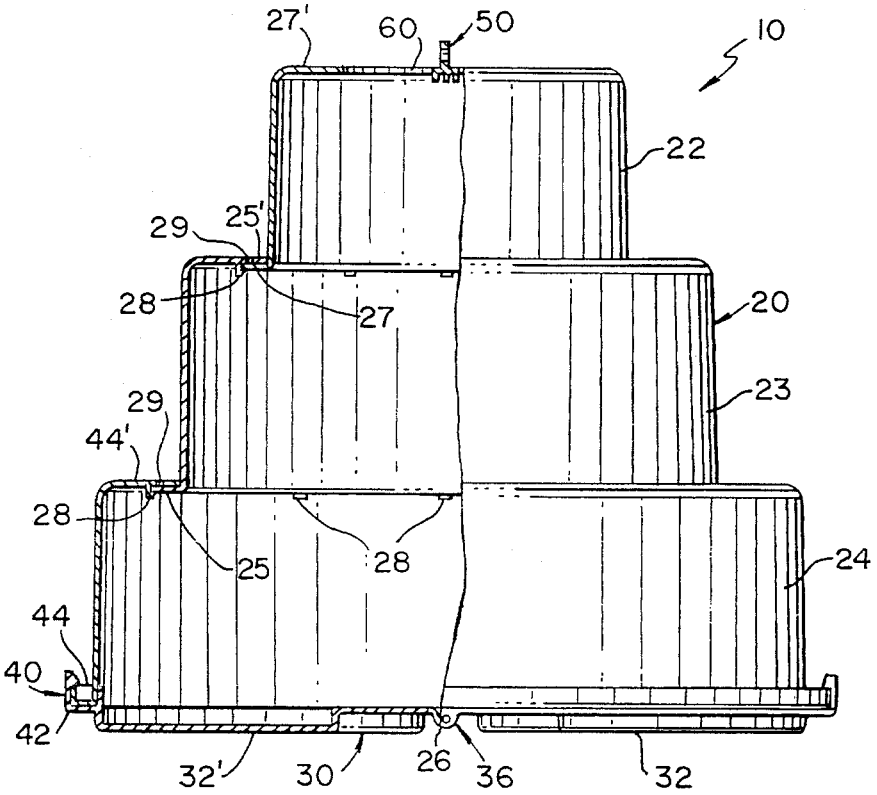
FIG. 4 is a representation of an elevational and a partial cross-sectional view of this invention.

Collapsible container assembly 20 has, in the preferred embodiment, three coaxially and telescopically disposed tubular members 22; 23 and 24. Members 22; 23 and 24 do not need to have a circular cross-section. These members can have polygonal cross-sections. Members 23 and 24 include each cooperating locking tabs 28 designed to releasably lock adjacent members 22; 23 and 24 in distended position. Tubular member 22 is the uppermost and smallest diameter tubular of assembly 20 and includes openings 60. Openings 60 are semicircles, in the preferred embodiment, and are designed to permit the loading of candy, children's games and toys inside the hollow structure of collapsible container assembly 20. Tubular member 24 constitutes the lowermost tubular member of assembly 20. Base assembly 30 is pivotally mounted to member 24, as best seen in FIGS. 1 and 4.

Base assembly 30, in the preferred embodiment, includes semicircle flaps 32 and 32' that are pivotally mounted to hinge assembly 36. Hinge assembly 36 is removably mounted to ear members 26 and 26' projecting downwardly from flanged rim 44. Flaps 32 and 32' have, at their distal portion, several openings 33 through which strings 34 pass. Strings 34 are pulled by participating children causing flaps 32 and 32' to swing downwardly, as shown in FIG. 1. The candy, toys and objects inside pinata 10 fall and participating children scramble for them.

Figure 2:
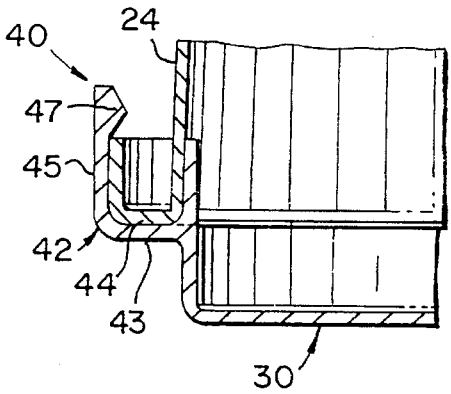
FIG. 2 shows a partial elevational cross section of the latching mechanism used to latch the base assembly against the lowermost tubular member of this invention.

Base assembly 30 is releasably latched to flanged rim 44 of member 24 by latching mechanism 40. As is shown in FIG. 2, latching mechanism 40 comprises preferably pocket member 42 and flanged rim 44. Pocket member 42 includes spacer wall 43 and perpendicularly extending wall 45 with inwardly extending protuberance 47. Flanged rim 44 is snugly received by pocket member 42 keeping flaps 32 and 32' against the bottom flanged rim 44 of member 24.

When flaps 32 and 32' are pushed towards flanged rim 44, the latter cammingly pushes resilient wall 45 outwardly until flanged rim 44 clears protuberance 47, as shown in FIG. 2. When the children pull strings 34 with sufficient force, flaps 32 and 32' are urged downwardly overcoming the inwardly force of resilient wall 45 when flanged rim 44 cammingly pushes protuberance 47 outwardly.

Figure 5:
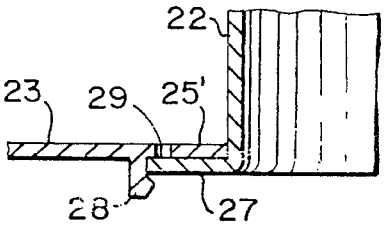
FIG. 5 is a partial elevational cross-section of the locking tabs used to mount the tubular members to each other.
Figure 3:
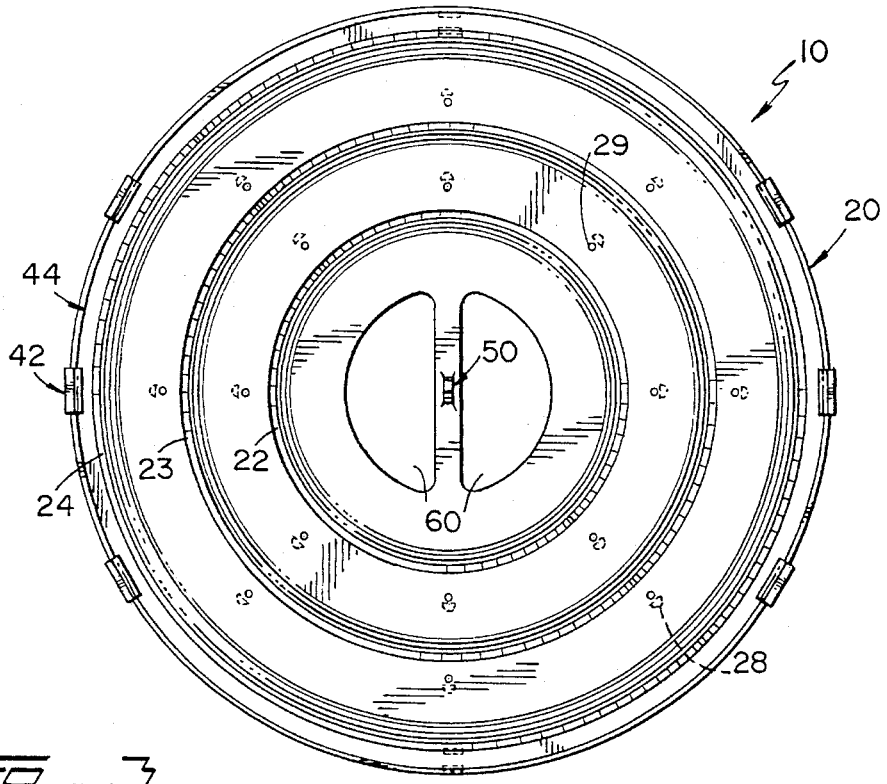
FIG. 3 illustrates a top view of the present invention.

As best seen in FIG. 4, tubular members 22; 23 and 24 are coaxially nested within each other. Lower flange 25 of member 23 comes in contact with upper flange 44' of tubular member 24 when the latter is fully distended with respect to tubular member 23. Locking tabs 28 releasably keep lower flange 25 attached to upper flange 44'. Similarly, lower flange 27 of tubular member 22 is releasably mounted to upper flange 25' of tubular member 23 and kept attached to each other with locking tabs 28. Tubular member 22 has upper flange 27' that forms the uppermost part of container 20. Locking tabs 28, as shown in FIG. 5, are made out of a resilient material that permits the separation of abutting flanges to close container assembly 20 applying a small force downwardly. Opening 29 is designed to permit a user to introduce a pin to separate lower flange 27 from upper flange 25', as seen in FIG. 5. In this manner, member 22 is kept inside member 23 and the latter in turn is kept inside member 24, thereby facilitating its transportation and storage. However, more or less cylinders can also be used.

Collapsible container assembly 20 is suspended by holding cable 55. Holding cable 55 is tied to loop 50 that is rigidly mounted to the top of tubular member 22, as best seen in FIGS. 1;3 and 4.

Pinata 10 is preferably made out of a plastic material and can be adorned externally with different and bright colors and/or with character figures stuck to tubular members 22; 23 and 24. Hinge assembly 36, flaps 32 and 32' can be replaced with similar members with different looks, as desired.

Figure 6:
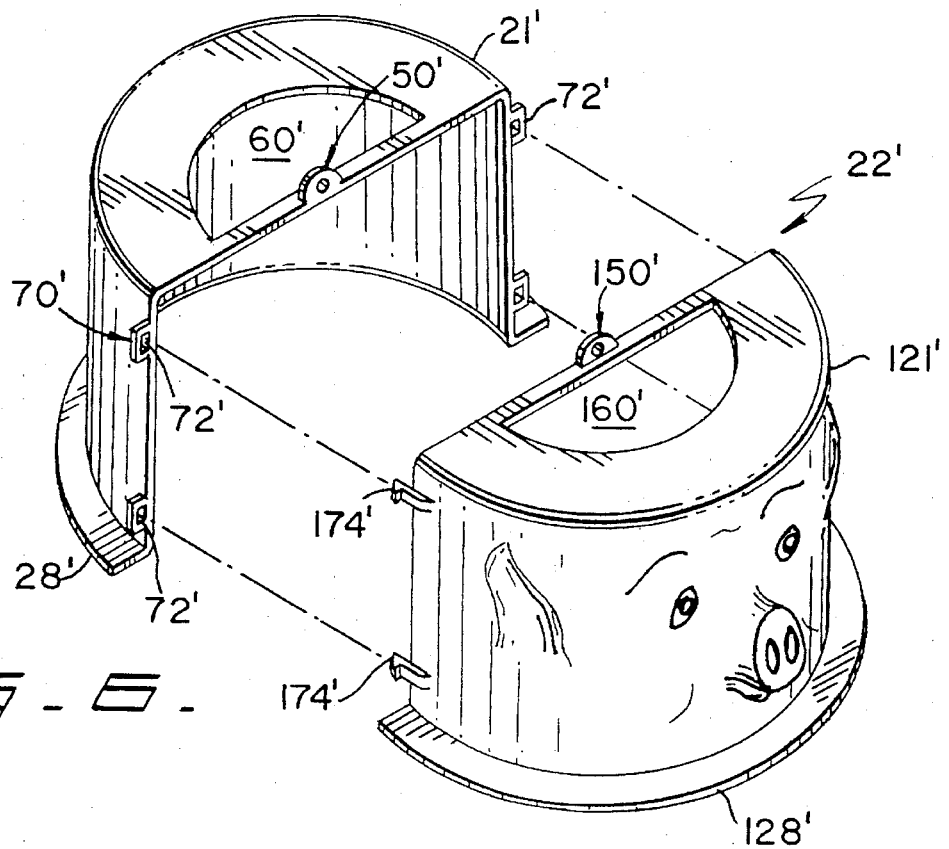
FIG. 6 is an isometric exploded view of an alternate embodiment for the uppermost tubular member.

In FIG. 6 an alternate embodiment for the tubular member referenced with numeral 22' is shown. This alternate embodiment is also applicable for tubular members 23 and 24, or others that may be added. The uppermost tubular member 22' is composed of sections 121' and 21' that cooperative latch on to each other. Male latching members 174' are removably inserted to female latching members 72'. Sections 21' and 121' can be molded with different character figures. Latching assembly 70', in this alternate embodiment, has female latching member 72' and male latching member 174'. Similarly to preferred embodiment 10, sections 21' and 121' have lower flanges 28' and 128' located at their lower edge, respectively. Sections 21' and 121' include openings 60' and 160', respectively, to introduce candy, children's games and toys through them. Tubular member 22' is suspended by loop assemblies 50' and 150' once the two sections 21' and 121' are locked together by latching assembly 70'. The objective being to have different uppermost tubular member 22' with different graphic and characters. In this manner, member 22' is interchangeable permitting the creation of different combinations with minimum storage space requirements. Also, the storage requirement is minimized by using two sections that can be housed within each other.

Figure 7:
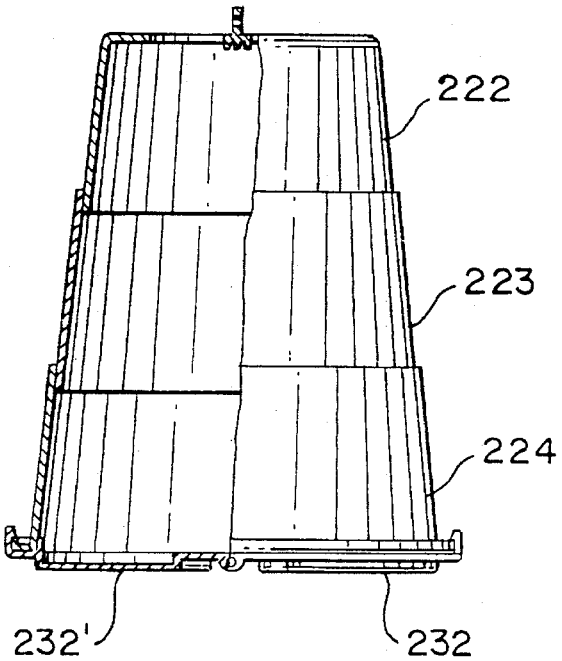
FIG. 7 is an elevational view of an alternate embodiment for the tubular members with a partial cross-section.

Another alternate embodiment is shown in FIG. 7, and it basically includes frustroconical tubular members 222; 223 and 224 that are coaxially and telescopically disposed within each other. The diameters are cooperatively selected to prevent the separation of members 222; 223 and 224, specially when filled with candy and other objects. This alternate embodiment does not require the use of lower flanges 27 and 25. Flap members 232 and 232' function in the same manner described above for flap members 32 and 32'.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A reusable telescopic pinata, comprising:

A) at least two tubular housing means coaxially and telescopically disposed within each other and each of said tubular housing means having first and second ends, and said first ends of each of said tubular housing means include an outwardly extending flange and each of said second ends having an inwardly extending flange so that said outwardly extending flange of said second ends come in contact with said inwardly extending flange of the smaller contiguous tubular housing means;

B) base means hingedly mounted to the first ends of the largest tubular housing means;

C) latching means for keeping said base means against said first ends of the largest tubular housing means;

D) means for holding the smallest of said tubular housing means;

E) a plurality of string members attached to said base means;

F) locking means for keeping said inwardly and outwardly flanges removably mounted to each other, thereby permitting said tubular housing means to stand in their fully distended telescopic position; and G) at least one of said tubular housing means include at least two sections wherein at least one of said sections is replaceable and includes a surface relief presenting and displaying a character when said pinata is fully distended and section latching means for removably mounting said sections together.

2. The pinata set forth in claim 1 wherein said base means includes two flaps that are hingedly mounted to said first ends along a common abutting line.

* * * * *